US010064782B1

(12) United States Patent
Levi et al.

(10) Patent No.: US 10,064,782 B1
(45) Date of Patent: Sep. 4, 2018

(54) MOBILITY ASSISTANCE DEVICE

(71) Applicants: ATTI International Services Company, Inc., Hauppauge, NY (US); Eli Levi, Dix Hills, NY (US)

(72) Inventors: Eli Levi, Dix Hills, NY (US); Richard Engel, Ridge, NY (US); Thomas Leddy, Eastport, NY (US)

(73) Assignee: ATTI International Services Company, Inc., Hauppauge, NY (US)

( * ) Notice: Subject to any disclaimer, the term of this patent is extended or adjusted under 35 U.S.C. 154(b) by 0 days.

(21) Appl. No.: 15/652,626

(22) Filed: Jul. 18, 2017

Related U.S. Application Data

(60) Provisional application No. 62/367,078, filed on Jul. 26, 2016.

(51) Int. Cl.
*A61H 3/04* (2006.01)

(52) U.S. Cl.
CPC ..... *A61H 3/04* (2013.01); *A61H 2003/046* (2013.01)

(58) Field of Classification Search
CPC ..... A61H 3/008; A61H 3/04; A61H 2003/007
See application file for complete search history.

(56) References Cited

U.S. PATENT DOCUMENTS 2,719,568 A * 10/1955 Webb ..... A61H 3/008 2/69
3,761,082 A * 9/1973 Barthel, Jr. ..... A61H 3/008 182/3
4,256,098 A 3/1981 Swan et al.
4,303,041 A * 12/1981 Thompson ..... A61H 3/008 128/875
4,312,505 A * 1/1982 Engelhart ..... A61H 3/04 482/68
4,770,410 A * 9/1988 Brown ..... A61H 3/04 135/67
4,941,497 A * 7/1990 Prather ..... A61H 3/008 135/67
5,080,383 A * 1/1992 Hsieh ..... A47D 13/043 188/5
5,112,044 A * 5/1992 Dubats ..... A61H 3/04 135/85
5,348,035 A * 9/1994 Porter ..... A61H 3/02 135/66
5,526,893 A * 6/1996 Higer ..... A61H 3/04 180/65.1
5,772,234 A 6/1998 Luo
5,813,948 A * 9/1998 Quigg ..... A61H 3/04 280/87.041
5,893,367 A * 4/1999 Dubats ..... A61F 5/0193 128/875
6,439,250 B1 * 8/2002 Balan ..... A61H 3/008 135/66

(Continued)

*Primary Examiner* — Erez Gurari
(74) *Attorney, Agent, or Firm* — Brian Roffe

(57) ABSTRACT

Wheeled walker with an integrated safety system includes a frame, wheels on the frame to enable the frame to be manually moved along a surface, and a belt/tether apparatus including a belt adapted to be attached to a person using the walker and at least one tether connected at a first end region to the frame and at a second end region to the belt. The tether may include an elastic portion that provides a proportional tension as distance beyond a slack distance of the elastic portion increases. This limits separation of the walker from the person attached to the belt.

25 Claims, 7 Drawing Sheets

(56) References Cited

U.S. PATENT DOCUMENTS 6,742,523 B2 * 6/2004 Dubats ..... A61H 3/008 128/875
6,899,660 B1 5/2005 Chin et al.
7,814,866 B1 10/2010 Gramza
8,409,116 B2 4/2013 Wang et al.
8,663,133 B2 * 3/2014 Johnson ..... A61F 5/24 482/78
9,125,790 B2 9/2015 Van Gerpen
2001/0045227 A1 * 11/2001 Balan ..... A61H 3/008 135/67
2005/0183759 A1 * 8/2005 Wolfe ..... A61H 3/04 135/67
2008/0053253 A1 3/2008 Moore et al.
2009/0036815 A1 * 2/2009 Ido ..... A61H 1/0237 602/23
2009/0292369 A1 * 11/2009 Kazerooni ..... B25J 9/0006 623/27
2010/0126542 A1 * 5/2010 Pennise ..... A61H 3/04 135/67
2010/0170546 A1 * 7/2010 Popovic ..... A61H 3/008 135/67
2012/0042917 A1 * 2/2012 Workman ..... A61H 3/008 135/66
2014/0249452 A1 9/2014 Marsh et al.
2014/0265199 A1 * 9/2014 Bagheri ..... A61G 5/1002 280/87.041
2014/0303508 A1 10/2014 Plotnik-Peleg et al.
2015/0115556 A1 * 4/2015 Ledea ..... A61H 3/04 280/79.11
2015/0283020 A1 10/2015 Kim et al.
2016/0166454 A1 * 6/2016 Johnson ..... A63B 69/0064 280/1.5
2016/0242392 A1 * 8/2016 Holzworth ..... A61H 3/008
2016/0253890 A1 9/2016 Rabinowitz et al.
2016/0287465 A1 10/2016 Rabin et al.
2017/0007491 A1 * 1/2017 Crombie ..... B32B 5/022
2017/0231855 A1 * 8/2017 Frazier, Jr. ..... A61H 3/008 135/66
2017/0231856 A1 * 8/2017 Karlovich ..... A61H 3/008 607/148
2017/0318976 A1 * 11/2017 Journey ..... A47C 16/025

* cited by examiner

Standard Side
Release Buckle

Break-Away Side
Release Buckle

Item 32

MOBILITY ASSISTANCE DEVICE

FIELD OF THE INVENTION

The present invention relates generally to a mobility assistance device that could be used, for example, to provide mobility assistance to individuals living with a debilitating disease, in particular, Parkinson's disease.

BACKGROUND OF THE INVENTION

As many as one million Americans currently live with Parkinson's disease with approximately 60,000 more Americans diagnosed each year, not including thousands more that likely go undetected. Parkinson's disease is often considered to be caused by a deficiency of dopamine in the basal ganglia circuit which leads to motor deficits. Although symptoms of Parkinson's disease are varied, one of the most affected motor characteristics is gait.

Festinating gait (also known as Parkinsonian gait) is characterized by a quickening and shortening of normal strides. Festinating gait can be disruptive for an individual diagnosed with Parkinson's disease and may interfere with the ability to work and engage in daily activities.

One common symptom in the advanced stages of the disease is referred to as Freezing of Gait (FOG). FOG is typically a transient episode that lasts less than a minute. During a FOG episode, gait halts with patients describing the situation as having his/her feet glued to the ground; when the patient overcomes the block, walking normally resumes.

Many Parkinson's patients use some form of wheeled walker (also known as a rolling walker or rollator) for mobility. Wheeled walkers may provide additional needed stability and are available in various configurations which can include: a seat rest, hand brake(s) and optional visual/audio cueing. During a FOG episode, an individual using a walker may encounter a situation where his/her feet are 'glued' to the floor but the walker continues to move forward slowly. The result is embarrassing and potentially dangerous situation in which the wheeled walker gets further and further away from the individual, at best ending up with the individual in a bent over position but helpless to do anything about it, or worse, resulting in a fall.

OBJECTS AND SUMMARY OF THE INVENTION

An object of at least one embodiment of the present invention is to provide an individual using a wheeled walker, a tethered belt to limit the permissible distance the wheeled walker may advance without the individual advancing in the direction of movement. The tether can be used by itself or integrated with a braking system that applies the wheeled walker brakes when necessary.

A wheeled walker with an integrated safety system in accordance with the invention includes a frame, a movement enabling system on the frame that enables the frame to be manually moved along a surface, and a belt/tether apparatus including a belt adapted to be attached to a person using the walker and at least one tether connected at a first end region to the frame and at a second end region to the belt. Such connection of the tether may be a direct connection to the frame or belt or indirect connection through other intermediate or intervening structure.

The belt may be any known structure that functions as a conventional belt, for example, structure configured to be placed around a waist of the person using the walker and preferably adjustable to enable people with different waist sizes to use the belt. Also, the belt may be configured to have a height to support lumbar vertebrae and sufficient rigidity to maintain natural curvature of the individual's lower back when attached to the person. The belt could also be configured to be placed around other parts of the user. Multiple belts may be used and placed, for example, around different parts of the user.

The movement enabling system typically includes wheels mounted at a lower region of the frame.

Each tether may be elongate and include a buckle component that enables its length to be adjusted. A strap webbing is optionally connected at one end region to the belt and at an opposite end region to the buckle component. As such, the buckle component enables a length of the strap webbing between the belt and the buckle component to be adjusted. When two tethers are provided, a first tether is advantageously arranged on one side of the belt and a second tether is advantageously arranged on an opposite side of the belt.

In another embodiment, one or more tethers each include a buckle having first and second cooperating components that selectively engage with one another and are releasable from engagement with one another. A strap webbing is connected at one end region to the belt and at an opposite end region to the first component. An elastic portion is connected at one end region to the frame and at an opposite end region to the second component. The buckle may be a side release buckle. Optionally, each tether includes an elastic portion between the frame and the second component which provides a proportional tension as distance beyond a slack distance of the elastic portion increases. The elastic portion may be attached at one end region to the frame and at an opposite end region to the second component.

In some embodiments, one or more tethers each include a buckle having first and second cooperating components selectively engaged with one another and releasable from engagement with one another. The first component is configured to break away from the second component when tension in the tether exceeds a threshold tension.

An optional feature is a braking mechanism that interacts with the movement enabling system to prevent movement of the frame when tension on the tether exceeds a threshold, for example, one derived from a distance between the belt and the frame. This braking mechanism can have different forms and in one embodiment, includes an actuatable brake, a wire fixed at one end to the brake and configured such that application of tension to the wire causes actuation of the brake, and a wheel over which the wire passes. The wheel is coupled to the tether and moves in one direction to apply tension to the wire and thereby cause actuation of the brake when tension on the tether exceeds the threshold.

In another embodiment, the braking mechanism includes an actuatable brake, a wire fixed at one end to the brake and configured such that release of tension on the wire causes actuation of the brake, and a wheel over which the wire passes. The wheel is coupled to the tether and configured to move in one direction to release tension on the wire and thereby cause actuation of the brake when tension on the tether exceeds the threshold.

In yet another embodiment, the braking mechanism includes an actuatable brake, and a cable comprising an outer casing and an inner wire. The inner wire is fixed at one end to the brake and configured such that pulling of the inner wire causes actuation of the brake. The outer casing has first and second separate parts, the first part being attached to the frame and the second part being coupled to the tether and configured such that when tension on the tether exceeds the threshold, the second part of the outer casing moves away from the first part of the outer casing and thereby pulls the inner wire.

In still another embodiment, the braking mechanism includes an actuatable brake, and a cable comprising an outer casing and an inner wire. The inner wire is fixed at one end to the brake and configured such that tension release of the inner wire causes actuation of the brake. The outer casing has first and second separate parts, the first part being attached to the frame and the second part being coupled to the tether and configured such that when tension on the tether exceeds the threshold, the second part of the outer casing moves toward the first part of the outer casing and thereby releases tension of the inner wire.

The invention will be described in detail with reference to some preferred embodiments of the invention illustrated in the figures in the accompanying drawings. However, the invention is not confined to the illustrated and described embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE INVENTION

Wheeled walkers have been used for many decades as a way of providing increased mobility to people who find the daily task of walking a challenge. Initially, walkers started out as rigid frames and through incremental improvements over the years, are now foldable and can be equipped with a seat, a basket, wheels, brakes, etc. While these improvements address features that may have been lacking in prior designs, they can also introduce new issues that require remediation. The invention disclosed herein seeks to address one of these issues.

For the sake of clarity, all discussions will be directed to a fully wheeled walker—that is to say any portion of the walker that touches the floor/ground will have some form of fixed/free wheel or caster to allow movement, but the invention is in no way limited to a fully wheeled walker. So, generally, it will be considered that the walker integrating a safety system in accordance with the invention includes a movement enabling system on a frame of the walker that enables the frame to be manually moved by the user along a surface. The movement enabling system may include the wheels or casters at each portion that contacts the surface or only a portion thereof.

Figure 1:
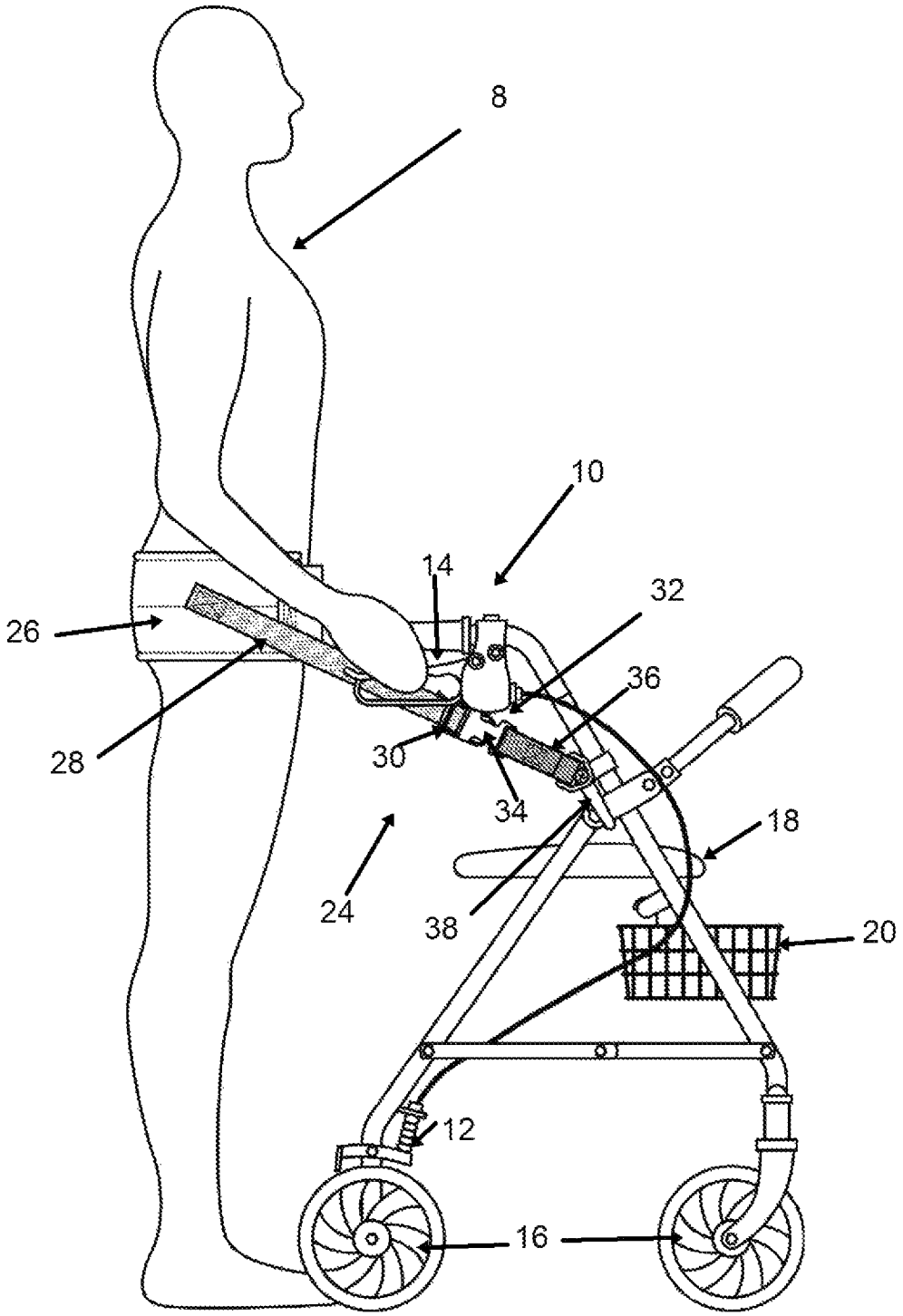
FIG. 1 shows an individual with a safety belt in accordance with the invention tethered to a wheeled walker.

FIG. 1 shows a garden variety, conventional walker 10 that is commonly available at the time of this application. This walker 10 includes brakes 12 actuated by a braking mechanism 14 for each hand to better control the movement of the walker 10. Walker 10 also includes wheels 16 on a lower portion of the frame of the walker 10 (the movement enabling system), a seat 18 attached to the frame and a basket 20 also attached to the frame.

Figure 2:
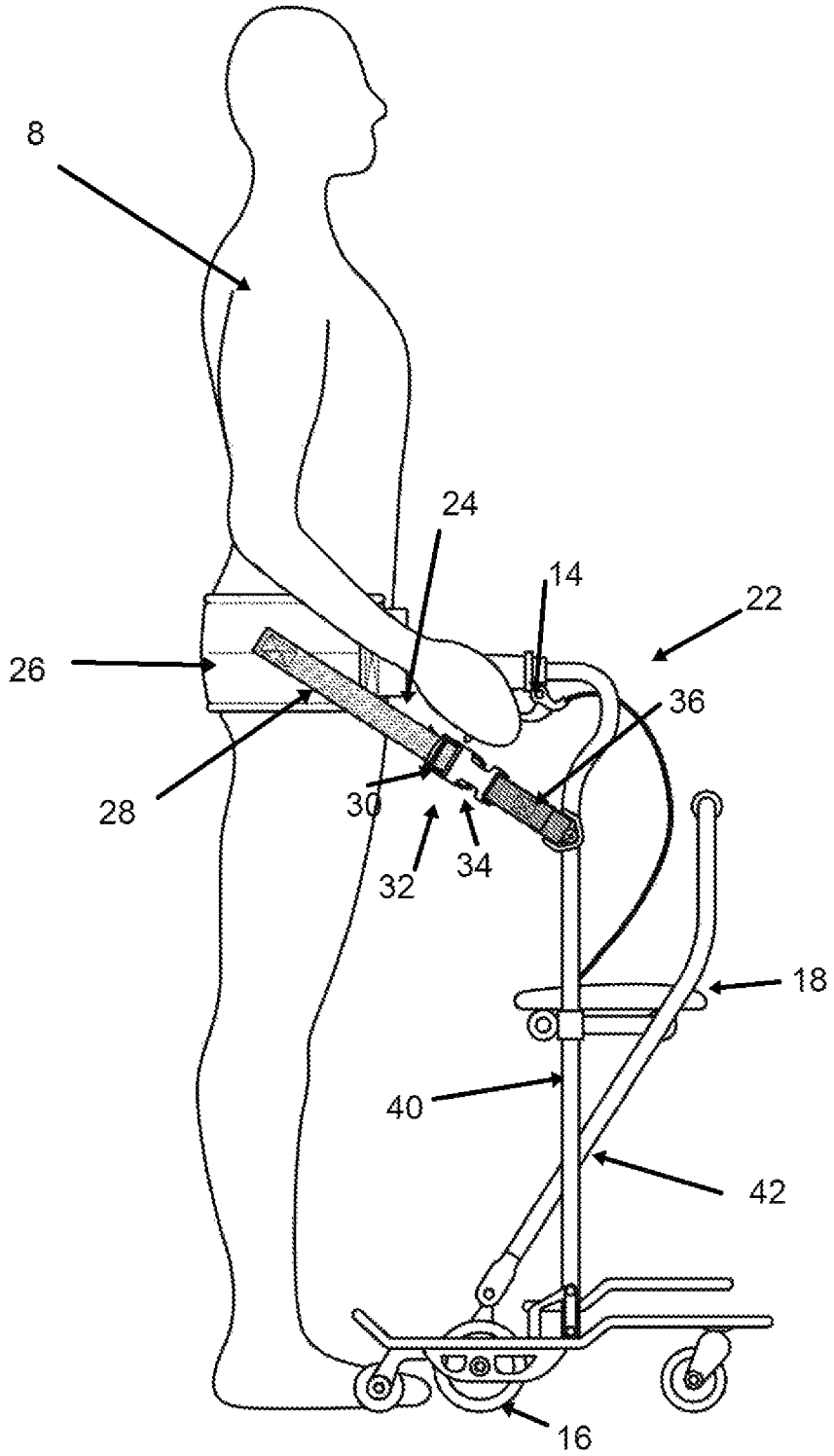
FIG. 2 shows an individual with a safety belt in accordance with the invention tethered to a stabilized wheeled walker.

FIG. 2 illustrates a walker 22 that has a lower center of gravity for better stability, and also includes wheels 16 on a lower portion of the frame of the walker 22, and a seat 18 attached to the frame.

Braking on either style of the walker 10, 22 can be direct acting (squeeze to apply brake) or deadman style (squeeze to release brake). The deadman style is often considered the preferred type of braking as it permits an individual to use the walker 10, 22 as a stable form of support when getting up from a sitting position. Regardless of braking type, the invention is capable of being installed as either a retrofit option on an existing walker 10, 22 or incorporated into the design of a new walker.

Figure 3:
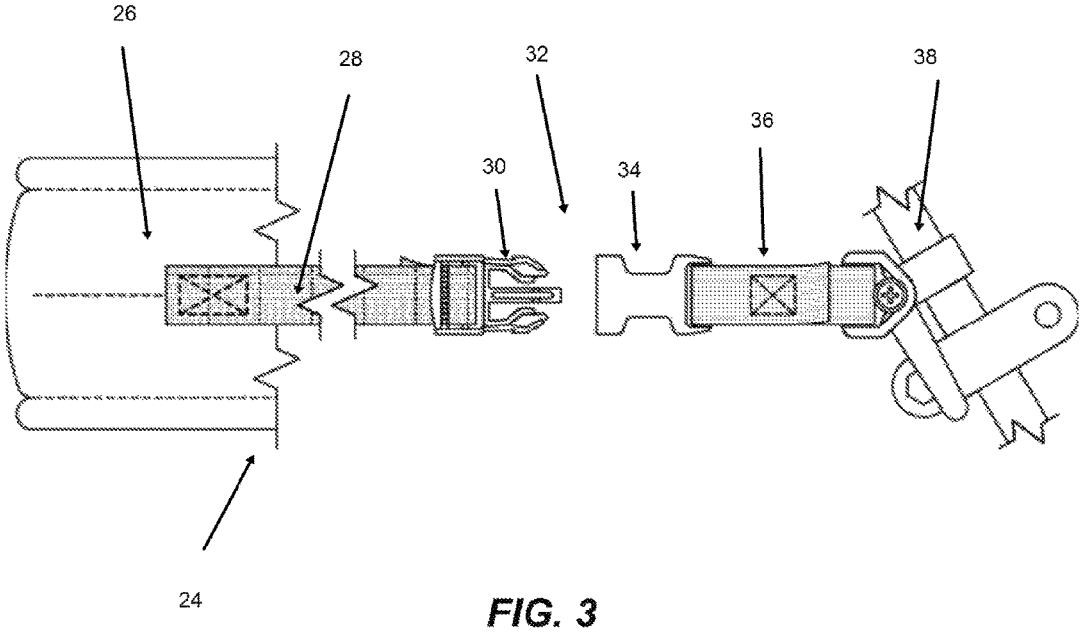
FIG. 3 depicts an exemplifying construction of the belt/tether in accordance with the invention.

FIG. 3 details the construction of a belt/tether apparatus 24 that is used with the wheeled walker 10, 22 in accordance with the invention. The belt/tether apparatus 24 includes a belt 26 that allows reasonable adjustment for an individual's waist size and a section of strap webbing 28 stitched to either side of the belt 26 (only one side is shown in FIGS. 1-3). The strap webbing 28 is part of a tether assembly of the belt/tether apparatus 24. It is possible to provide the belt/tether apparatus 24 with only a single section of strap webbing 28.

The belt 26 may optionally include provisions for lumbar support as older individuals using walkers sometimes have a tendency to hunch over which can result in complaints of back pain. The lumbar vertebrae are located in the lower part of the spinal column and can cause excruciating lower back pain caused by the conditions sciatica, a slipped disc, facet syndrome, spinal stenosis and degenerative disc disease. These conditions are often brought on or aggravated by weak core muscles or overuse of the back muscles which lead them to become strained. Typically, back support belts are designed to support and improve back posture, thus treating and managing this pain. Lumbar support belts can be adjusted to maintain the natural curve of the lower back and relieve back pain. If optional provisions for lumbar support are included, the belt 26 must be of sufficient height so as to support the lumbar vertebrae and sufficient rigidity so as to maintain the natural curvature of the individual's lower back. Formation of support belts having sufficient height and material construction to achieve lumbar support control is known to those skilled in the art of human spinal physiology.

It is possible to provide two or more belts 26 with the walker 10, 22 and each may be designed to be placed around a different part of the user.

Each of the strap webbings (also referred as straps) 28 would typically pass through one buckle component 30 of a side release buckle 32 which allows adjustment of the individual's position relative to the wheeled walker 10, 22 as well as allowing quick attachment/detachment from the walker 10, 22. The side release buckle 32 is also considered part of the belt/tether apparatus 24 and more specifically part of the tether assembly thereof. The structure of a side release buckle 32 having two components, the male member or component (hook end) 30, and female member (catch end)

34 that are selectively engaged with one another and releasable from engagement with one another is known to those skilled in the buckle field, as well as the structure of one of these components to provide adjustability in the length of the strap webbings 28 between the male buckle member or component 30 and the site at which the strap webbing 28 is attached to the belt 26.

The side release buckle 32 preferably incorporates a 'break-away' design feature to prevent injury in the event the individual using the walker 10, 22 loses his/her balance and falls backward. Without the break-away design feature, the individual could potentially pull the wheeled walker 10, 22 backwards on top of him/herself during a backwards fall, causing additional injury. The 'break-away' configured side release buckle 32 would release when subjected to a nominal axial tension of, for example, 20 pounds-force although a variety of tension release points may be necessary based on an individual's size/weight.

Figure 3B:
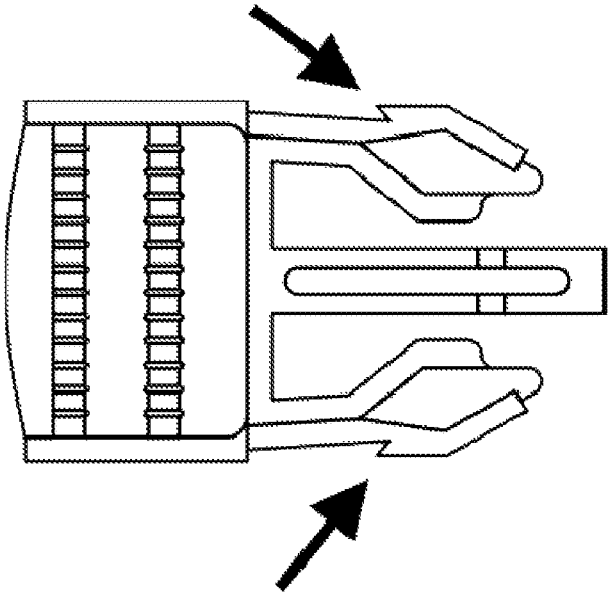
FIGS. 3*a* and 3*b* provide a visual comparison of the profile of a standard side release buckle with that of a break-away style buckle used in the invention.
Figure 3A:
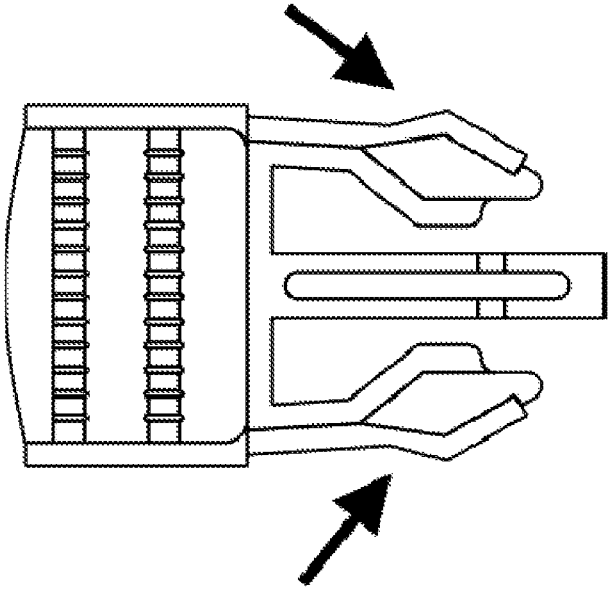

In one nonlimiting configuration, in order to achieve the break away capability, the sharp mating edge of the male member or component (hook end) 30 where it engages the female member (catch end) 34 is smoothed to allow the engagement to slip when the desired tension is applied. A break-away version and a typical side release buckle 32 are shown in FIGS. 3*a* and 3*b*, respectively. Each of FIGS. 3*a* and 3*b* shows an exaggerated view of this mating edge; instead of providing a firm engagement between the buckle members, the softened edges allow slippage (break-away) when a pre-defined tension is reached. In a preferred embodiment, the 'break-away' tension release point could be adjustable thus preventing the need for multiple buckles.

The female buckle member 34 is attached to a short loop (for example, less than about 12" total length) of an elongate portion of braided elastic 36 to provide an increasing (proportional) amount of tension as the distance between the individual 8 and wheeled walker 10, 22 increases. The elastic portion 36 is also part of the belt/tether apparatus 24 and more specifically, part of the tether assembly thereof. The elastic portion 36 generally provides a proportional tension as distance beyond a slack distance of the elastic portion 36 increases. Formation of braided elastic to achieve this tension control is known to those skilled in the art of elastic components.

Attachment of the looped elastic portion 36 to the walker 10, 22 can be via direct connection to the wheeled walker structure or frame 38 at a point slightly lower than the individual's waist using a B.D. ring connected to opposite sides of the short loop of braided elastic portion 36 (FIGS. 1 and 3). In FIG. 2, the looped elastic portion 36 is attached to a vertically extending frame portion 40 of the wheeled walker structure 38. Instead of a looped elastic portion 36, other elastic components may be used that provide increasing tension as a function of stretching.

In alternate embodiments, the short braided loop of elastic portion 36 can be tied into the braking mechanism 14 of the wheeled walker 10, 22. Instead of a direct connection to the wheeled walker structure 38, 40, the short braided loop of elastic portion 36 could connect to an inline braking mechanism 44 that is also capable of applying the brakes 12 when tension from the belt/tether apparatus 24 is exerted.

Figure 4:
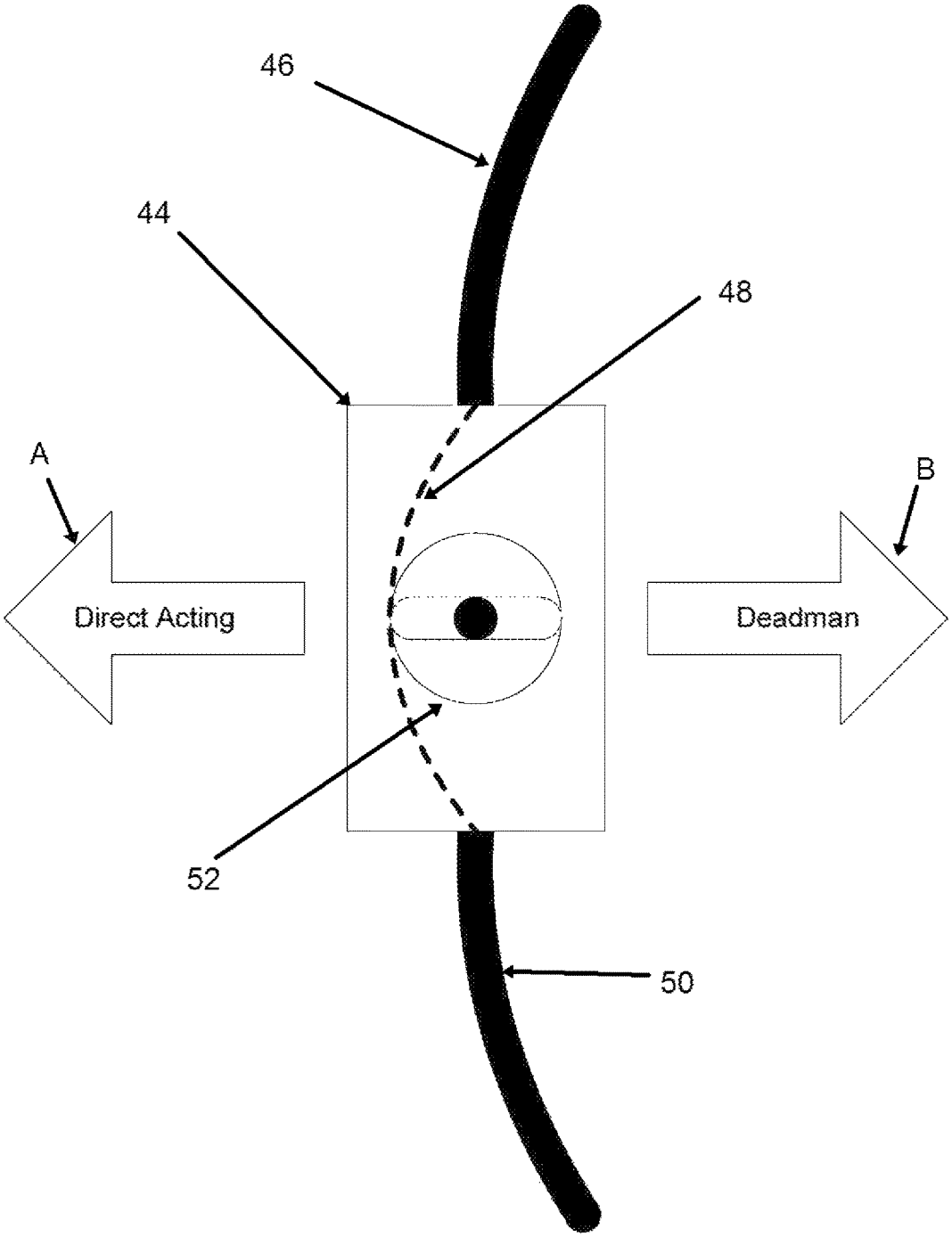
FIG. 4 reflects an inline brake application method in which an inline braking mechanism is coupled with a belt/tether apparatus in accordance with the invention.

FIG. 4 schematically shows an inline braking mechanism 44 which is one such way of applying the brakes 12 when there is tension on the tether of the belt/tether apparatus 24. Generally, this entails integrating the inline braking mechanism 44 with the tether of the belt/tether apparatus 24 to effect action of the braking mechanism as a function of the tension in the tether. Structure other than disclosed above that can actuate a braking mechanism as a function of tension of a tether of a belt/tether apparatus 24 that is attached to a person and to a frame of the walker may also be used in the invention without deviating from the scope and spirit thereof.

A typical brake cable 46 (also known as a Bowden cable) consists of an inner stranded brake wire 48 surrounded by an outer casing 50. The inline braking mechanism 44 shown in FIG. 4 would preferably be installed at a location on the wheeled walker structure 38, 40 slightly lower than the individual's waist where there is access to the brake cable(s) 46. The outer casing 50 of the brake cable 46 would be cut/truncated with the mechanism 44 inserted at the cut point. The inner wire 48 would pass over a wheel 52 which is restricted to move orthogonally from the plane of the wire's entry/exit. For direct acting style of brakes, the wheel 52 would be pulled further outward, increasing the length of the inner wire 48 and thus applying brake pressure when tension is exerted by the belt/tether apparatus 24 (the direction of arrow A). Tension on the belt/tether apparatus 24, and more specifically, on the tether above a threshold thereby causes movement of the wheel 52 which is coupled thereto and this movement of the wheel 52 in the direction of arrow A causes the actuation of the brakes 12. Actuation of the brakes 12 could otherwise occur when the user pulls the braking mechanism 14 to which an end region of the inner wire 48 is attached or fixed.

The deadman style of brakes operate in the opposite manner; releasing cable tension in the brake cable 46 applies the brakes 12. For deadman style of brakes, the wheel 52 would be pulled further inward decreasing the length of the inner wire 48 and thus releasing cable tension/applying brake pressure when tension is exerted by the tether of the belt/tether apparatus 24 (the direction of arrow B). In this embodiment, the same mechanism 44 could be used for either style of wheeled walker braking.

Figure 5A:
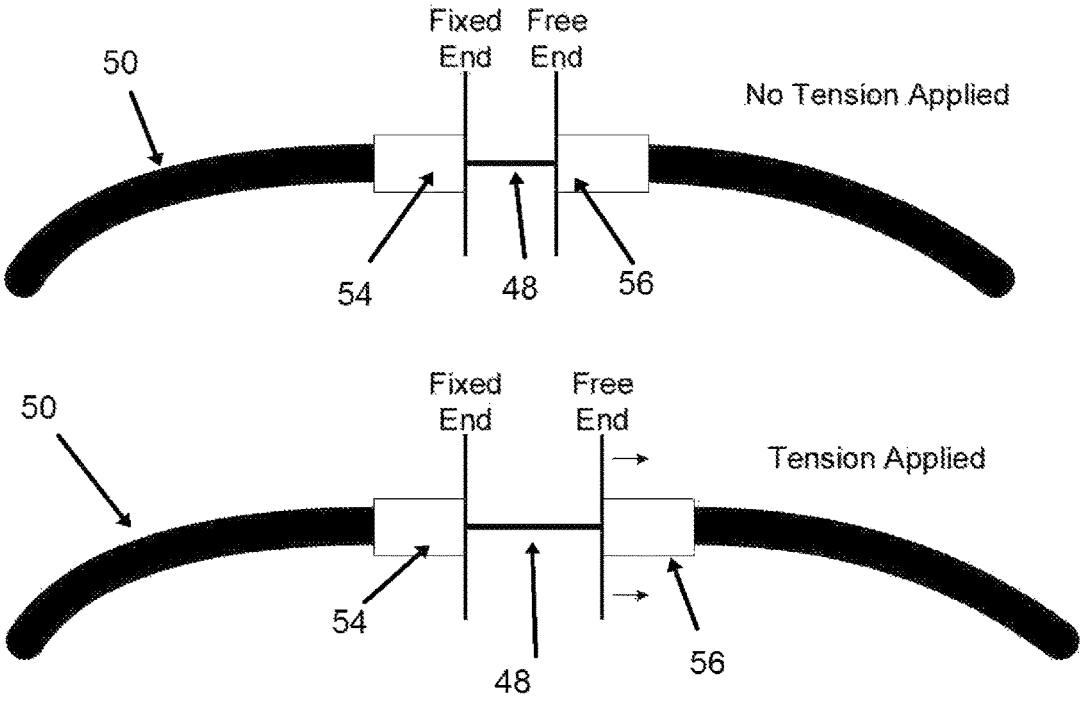
FIGS. 5*a* and 5*b* illustrate alternate inline brake application methods in which an inline braking mechanism is coupled with a belt/tether apparatus in accordance with the invention.
Figure 5B:
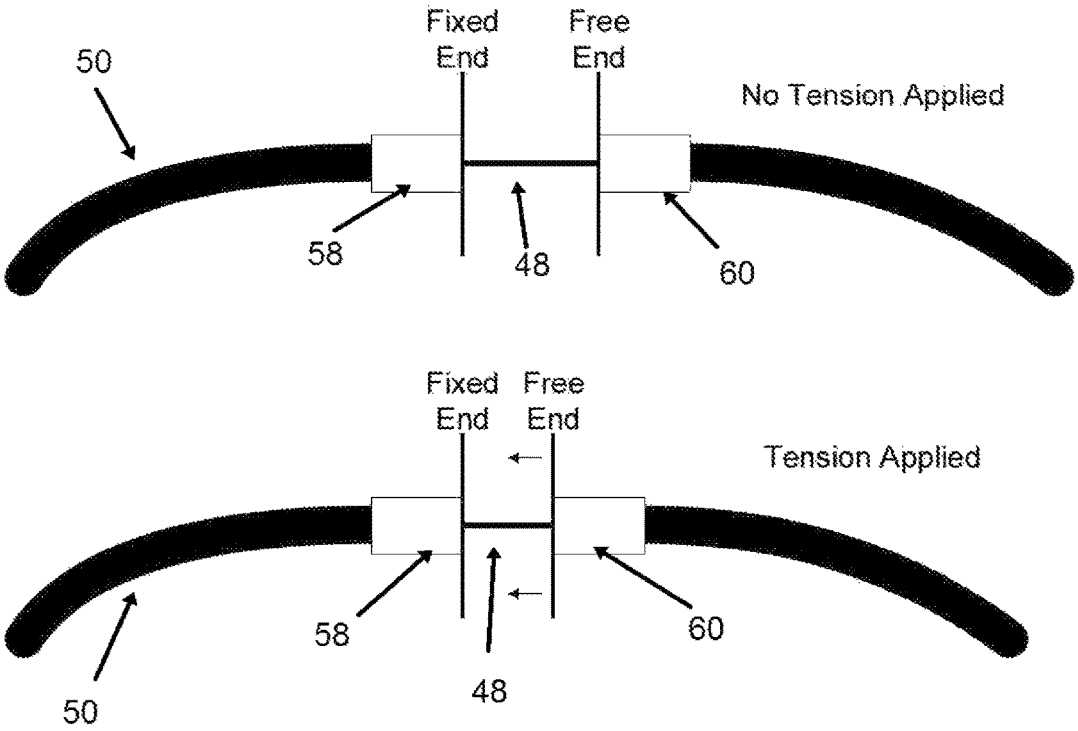

FIG. 5*a* (direct acting brake) and FIG. 5*b* (deadman brake) reflect yet other more cost effective embodiments to integrating the tether of the belt/tether apparatus 24 into the wheeled walker's braking. In FIG. 5*a* (direct acting brake), the outer casing 50 of the brake cable 46 would be cut and one end region 54 attached (fixed) to the wheeled walker structure 38, 40. The other, free end region 56 would be pulled axially away from the fixed end region 54 when tension is exerted by the belt/tether apparatus 24, the lower illustration. Increasing the distance of separation between the two end regions 54, 56 of the outer casing 50 has the same effect of pulling the inner brake wire 48 (effectively shortening the length of the inner wire 48 relative to the outer casing 50).

In FIG. 5*b* (deadman brake), the outer casing 50 of the brake cable 46 would be would be cut and one end region 58 attached (fixed) to the wheeled walker structure 38, 40. The other, free end region 60 would be pulled axially toward the fixed end region 58 when tension is exerted by the belt/tether apparatus 24, the lower illustration. Decreasing the distance of separation of the end region 58, 60 of the outer casing 50 has the same effect of relaxing the inner brake wire 48 (effectively lengthening the length of the inner wire 48 relative to the outer casing 50).

In both braking styles, the tension resulting from the distance between the individual and the wheeled walker 10, 22 would apply the brakes 12 of the wheeled walker 10, 22 when it exceeds a comfortable distance range for the individual. This distance would be adjusted by the slack length of the strap webbing 28 stitched to either side of the belt/tether apparatus 24 and the side release buckle 32.

As an example of use, if the individual using the walker 10, 22 remains stationary while experiencing a FOG episode yet the wheeled walker 10, 22 continues to move forward, then the distance between the individual and the wheeled walker 10, 22 increases. If this distance exceeds a safe distance (readily ascertainable by those skilled in the field of managing patients subject to FOG episodes), then the individual will fall down. To prevent this, the safe distance is determined, i.e., the maximum distance between the individual in a stable, upright position and the wheeled walker 10, 22 is determined, e.g., through experimentation for each style of walker 10, 22. Then, the tether of the belt/tether apparatus 24 would be designed to allow for distancing of the walker 10, 22 from the individual up to the maximum safe distance, i.e., allow to be stretched in tension below a tension threshold for this distance, which threshold may be predetermined during design of the walker. Upon the distance between the walker 10, 22 and the individual approaching within a threshold of or being this distance, the tension in the tether of the belt/tether apparatus 24 would then exceed the predetermined threshold and cause braking action via the braking mechanism 42. Forward movement of the walker 10, 22 would stop and thereby keep the distance between the walker 10, 22 and the individual at or within the safe distance.

For any of the inline braking methods disclosed, the short braided elastic loop portion 36 could attach to the inline braking mechanism 44 using a bolt-snap hook, overlapping arm snap, carabiner style spring link or similar sturdy quick connect/disconnect in lieu of the B.D. ring used as part of the direct connection to the wheeled walker structure.

Many wheeled walkers incorporate a fold down (or similar) seat to allow an individual to rest should walking become too strenuous. It is envisioned that the folding down action of the seat could also tie into or be integrated with or into the in-line braking system. When the seat is in use, i.e., in a down state, the brakes should be applied for two reasons. When the individual is sitting on the seat, the wheeled walker should remain in a fixed position to prevent a fall due to the walker rolling away from an individual. Individuals who utilize home health aides for mobility assistance may tend to use the walker as a wheelchair. Since these seats are provided mainly for resting purposes, their use for wheeling an individual around akin to a wheelchair results in undue stresses and strains which could potentially damage the walker. While the structure could be changed, the resulting bulkiness and weight would detract more than the value added. Tying the fold down seat into the in-line braking system would prevent the walker from being used as a wheelchair averting potential damage.

In another alternate embodiment, the inline braking system could incorporate a shutter mechanism within the attachment that keeps the wheeled walker brakes 12 applied until the individual using the walker 10, 22 makes the physical connection of the belt/tether apparatus 24, as an added safety measure. For new wheeled walker designs, the attachment point and inline braking mechanism 42 could be incorporated into the brake handles to reduce parts count and manufacturing steps to ultimately reduce cost. The combined attachment point, inline braking mechanism and brake handle assembly could also be used in retrofit applications for existing wheeled walkers, but due to the multitude of configurations available to the consumer, this type of retrofit option may not result in optimal attachment location and may require a large inventory of different designs to accommodate all variants.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and is not limiting. The invention is limited only as defined in the claims and equivalents thereto.

The invention claimed is:

1. A wheeled walker with an integrated safety system, comprising:
- a frame;
- a movement enabling system on said frame that enables said frame to be moved along a surface; and
- a belt/tether apparatus including
  - a belt adapted to be attached to a person using the walker; and
  - at least one elongate tether connected at a first end region to said frame and at a second end region to said belt,
  - each of said at least one elongate tether including
    - a buckle having first and second cooperating components that are selectively engaged with one another and releasable from engagement with one another,
    - a strap webbing connected at one end region to said belt and at an opposite end region to said first component, and
    - an elastic portion between said frame and said second component and connected at one end region to said frame and at an opposite end region to said second component,
    - whereby said elastic portion provides a proportional tension as distance beyond a slack distance of said elastic portion increases.

2. The walker of claim 1, wherein said first component enables a length of said strap webbing between said belt and said first component, and thus a length of said at least one elongate tether, to be adjusted.

3. The walker of claim 1, wherein said at least one elongate tether comprises a first elongate tether arranged on one side of said belt and a second elongate tether arranged on an opposite side of said belt.

4. The walker of claim 1, wherein said buckle is a side release buckle.

5. The walker of claim 1, wherein said elastic portion is attached at said one end region directly to said frame and attached at said opposite end region directly to said second component.

6. The walker of claim 1, wherein said first component is configured to break away from said second component when tension in said at least one elongate tether exceeds a threshold tension.

7. The walker of claim 1, further comprising a braking mechanism configured to interact with said movement enabling system to prevent movement of said frame when tension on said at least one elongate tether exceeds a threshold derived from a distance between said belt and said frame.

8. The walker of claim 7, wherein said braking mechanism comprises:
- an actuatable brake;
- a wire fixed at one end to said brake and configured such that application of tension to said wire causes actuation of said brake; and a wheel over which said wire passes, said wheel being coupled to said at least one elongate tether and configured to move in one direction to apply tension to said wire and thereby cause actuation of said brake when tension on said at least one elongate tether exceeds the threshold.

9. The walker of claim 7, wherein said braking mechanism comprises:

an actuatable brake;

a wire fixed at one end to said brake and configured such that release of tension on said wire causes actuation of said brake;

a wheel over which said wire passes, said wheel being coupled to said at least one elongate tether and configured to move in one direction to release tension on said wire and thereby cause actuation of said brake when tension on said at least one elongate tether exceeds the threshold.

10. The walker of claim 7, wherein said braking mechanism comprises:

an actuatable brake; and a cable comprising an outer casing and an inner wire, said inner wire being fixed at one end to said brake and configured such that pulling of said inner wire causes actuation of said brake, said outer casing having first and second separate parts, said first part being attached to said frame and said second part being coupled to said at least one elongate tether and configured such that when tension on said at least one elongate tether exceeds the threshold, said second part of said outer casing moves away from said first part of said outer casing and thereby pulls said inner wire.

11. The walker of claim 7, wherein said braking mechanism comprises:

an actuatable brake; and a cable comprising an outer casing and an inner wire, said inner wire being fixed at one end to said brake and configured such that tension release of said inner wire causes actuation of said brake, said outer casing having first and second separate parts, said first part being attached to said frame and said second part being coupled to said at least one elongate tether and configured such that when tension on said at least one elongate tether exceeds the threshold, said second part of said outer casing moves toward said first part of said outer casing and thereby releases tension of said inner wire.

12. The walker of claim 1, wherein said movement enabling system comprises a plurality of wheels mounted at a lower region of said frame.

13. The walker of claim 1, wherein said belt is configured to be placed around a waist of the person using the walker and adjustable to enable people with different waist sizes to use said belt.

14. The walker of claim 1, wherein said belt is configured to have a height to support lumbar vertebrae and sufficient rigidity to maintain natural curvature of the individual's lower back when said belt is attached to the person.

15. A wheeled walker with an integrated safety system, comprising:

a frame;

a movement enabling system on said frame that enables said frame to be moved along a surface; and a belt/tether apparatus including a belt adapted to be attached to a person using the walker, and at least one tether connected at a first end region to said frame and at a second end region to said belt, said at least one tether including a buckle having first and second cooperating components that are selectively engaged with one another and releasable from engagement with one another, said first component being configured to break away from said second component when tension in said at least one tether exceeds a threshold tension.

16. The walker of claim 15, wherein said buckle is a side release buckle.

17. The walker of claim 15, wherein said belt is configured to be placed around a waist of the person using the walker and adjustable to enable people with different waist sizes to use said belt.

18. A wheeled walker with an integrated safety system, comprising:

a frame;

a movement enabling system on said frame that enables said frame to be moved along a surface; and a belt/tether apparatus including a belt adapted to be attached to a person using the walker, and at least one tether connected at a first end region to said frame and at a second end region to said belt; and a braking mechanism configured to interact with said movement enabling system to prevent movement of said frame when tension on said at least one tether exceeds a threshold derived from a distance between said belt and said frame.

19. The walker of claim 18, wherein said braking mechanism comprises:

an actuatable brake;

a wire fixed at one end to said brake and configured such that application of tension to said wire causes actuation of said brake; and a wheel over which said wire passes, said wheel being coupled to said at least one tether and configured to move in one direction to apply tension to said wire and thereby cause actuation of said brake when tension on said at least one tether exceeds the threshold.

20. The walker of claim 18, wherein said braking mechanism comprises:

an actuatable brake;

a wire fixed at one end to said brake and configured such that release of tension on said wire causes actuation of said brake;

a wheel over which said wire passes, said wheel being coupled to said at least one tether and configured to move in one direction to release tension on said wire and thereby cause actuation of said brake when tension on said at least one tether exceeds the threshold.

21. The walker of claim 18, wherein said braking mechanism comprises:

an actuatable brake; and a cable comprising an outer casing and an inner wire, said inner wire being fixed at one end to said brake and configured such that pulling of said inner wire causes actuation of said brake, said outer casing having first and second separate parts, said first part being attached to said frame and said second part being coupled to said at least one tether and configured such that when tension on said at least one tether exceeds the threshold, said second part of said outer casing moves away from said first part of said outer casing and thereby pulls said inner wire.

22. The walker of claim 18, wherein said braking mechanism comprises:

an actuatable brake; and a cable comprising an outer casing and an inner wire, said inner wire being fixed at one end to said brake and configured such that tension release of said inner wire causes actuation of said brake, said outer casing having first and second separate parts, said first part being attached to said frame and said second part being coupled to said at least one tether and configured such that when tension on said at least one tether exceeds the threshold, said second part of said outer casing moves toward said first part of said outer casing and thereby releases tension of said inner wire.

23. The walker of claim 18, wherein said at least one tether is elongate and includes a side release buckle having first and second cooperating components that are selectively engaged with one another and releasable from engagement with one another, a strap webbing connected at one end region to said belt and at an opposite end region to said first component, and an elastic portion connected at one end region to said frame and at an opposite end region to said second component.

24. The walker of claim 18, wherein said at least one tether includes a buckle having first and second cooperating components that are selectively engaged with one another and releasable from engagement with one another, said first component being configured to break away from said second component when tension in said at least one tether exceeds a threshold tension.

25. The walker of claim 18, wherein said belt is configured to be placed around a waist of the person using the walker and adjustable to enable people with different waist sizes to use said belt.

* * * * *